US006848740B1

(12) United States Patent
Reese

(10) Patent No.: US 6,848,740 B1
(45) Date of Patent: Feb. 1, 2005

(54) COLLAPSIBLE CHAIR

(76) Inventor: Benjamin P. Reese, 20777 Mountain Dr., San Jose, CA (US) 95120

( * ) Notice: Subject to any disclaimer, the term of this patent is extended or adjusted under 35 U.S.C. 154(b) by 0 days.

(21) Appl. No.: 10/675,956

(22) Filed: Oct. 2, 2003

(51) Int. Cl.[7] ..... A47C 4/28; A47C 4/30; A47C 4/44; A47C 4/46

(52) U.S. Cl. ..... 297/16.1; 297/16.2; 297/42; 297/43; 297/45; 297/53; 297/54

(58) Field of Search ..... 297/16.1, 16.2, 297/42, 43, 45, 51, 53, 54

(56) References Cited

U.S. PATENT DOCUMENTS

| | | | | | |
|---|---|---|---|---|---|
| 1,914,006 | A | * | 6/1933 | Brown | 297/54 X |
| 2,703,137 | A | * | 3/1955 | Bierman | 297/53 X |
| 2,916,744 | A | * | 12/1959 | May et al. | 297/45 X |
| 5,320,404 | A | * | 6/1994 | Le Gal | 297/16.2 |
| 5,415,455 | A | * | 5/1995 | Geldbaugh | 297/45 |
| 5,496,094 | A | * | 3/1996 | Schwartzkopf et al. | 297/45 |
| 5,845,962 | A | * | 12/1998 | Lin | 297/54 |
| 5,915,782 | A | * | 6/1999 | Geldbaugh | 297/45 |
| 6,015,185 | A | * | 1/2000 | Buono | 297/16.1 X |
| 6,283,046 | B1 | * | 9/2001 | Tseng | 108/127 |
| 6,332,646 | B1 | * | 12/2001 | Tseng | 297/16.1 |
| 6,447,057 | B1 | * | 9/2002 | Chen | 297/16.2 |
| 6,702,371 | B2 | * | 3/2004 | Zheng | 297/16.2 |
| 2003/0234561 | A1 | * | 12/2003 | Zheng | 297/45 |

FOREIGN PATENT DOCUMENTS

| | | | | |
|---|---|---|---|---|
| DE | 3429926 | A1 | * 2/1986 | 297/16.1 |
| FR | 2651658 | A1 | * 3/1991 | 297/51 |

* cited by examiner

*Primary Examiner*—Rodney B. White
(74) *Attorney, Agent, or Firm*—Bacon & Thomas

(57) ABSTRACT

A collapsible chair. The chair includes a chair frame having two spaced leg structures and a top ring mounted to and supported on the leg structures. Each leg structure includes a top bar and front and rear side bars depending from the top bar to form a substantially U-shape. The top ring is fixed to the top bars. The front and rear side bars are rotatable with respect to the top bar for collapsing the chair frame. Front and rear ground members are respectively connected between the front side bars and the rear side bars. The ground members have a U-shaped configuration having a bottom section positionable on a fixture and first and second side sections extending from opposite ends of the bottom section. The first side section is rotatably fit over a lower end of a first one of the front side bars or the rear side bars of the leg structures and the second side section is removably fit over a second one of the front side bars or the rear side bar of the leg structures.

5 Claims, 6 Drawing Sheets

COLLAPSIBLE CHAIR

BACKGROUND OF THE INVENTION

1. Field of the Invention

The present invention relates generally to a collapsible a nd inclination adjustable chair structure.

2. The Related Art

Chairs having collapsible structures are known and are available in the market. Some of the conventional collapsible chairs have a complicated collapsing mechanism, which makes the chairs expensive and troublesome in collapse. On the other hand, chairs that allow a person to lie down thereon are also known. Some of such chairs are featured with inclination adjustability, which allows for adjustment of the inclination of a portion of the chair, such as a backrest, to comfort the person lying down thereon.

The present invention is aimed to provide a collapsible chair having a simple structure and capable of inclination adjustment.

SUMMARY OF THE INVENTION

Therefore, a primary object of the present invention is to provide a collapsible chair having a simple structure and thus low costs.

Another object of the present invention is to provide a collapsible chair having an adjustable inclination.

To achieve the above objects, in accordance with the present invention, there is provided a collapsible chair comprising a chair frame comprised of two spaced leg structures and a top ring mounted to and supported on the leg structures. Each leg structure comprises a top bar and front and rear side bars depending from the top bar to form a substantially U-shape. The top ring is fixed to the top bars. The front and rear side bars are rotatable with respect to the top bar for collapsing the chair frame. Front and rear ground members are respectively connected between the front side bars and the rear side bars. The ground members have a U-shaped configuration comprised of a bottom section positionable on a fixture and first and second side sections extending from opposite ends of the bottom section. The first side section is rotatably fit over a lower end of a first one of the front side bars or the rear side bars of the leg structures and the second side section is removably fit over a second one of the front side bars or the rear side bas of the leg structures. By removing the second section from the second front side bar or second rear side bar, the ground member is allowed to rotate with respect to the leg structure for collapsing. A flexible sheet made of for example fabrics, resilient plastics and knitted products, is received in and attached to the top ring for supporting a person sitting thereon.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 6:
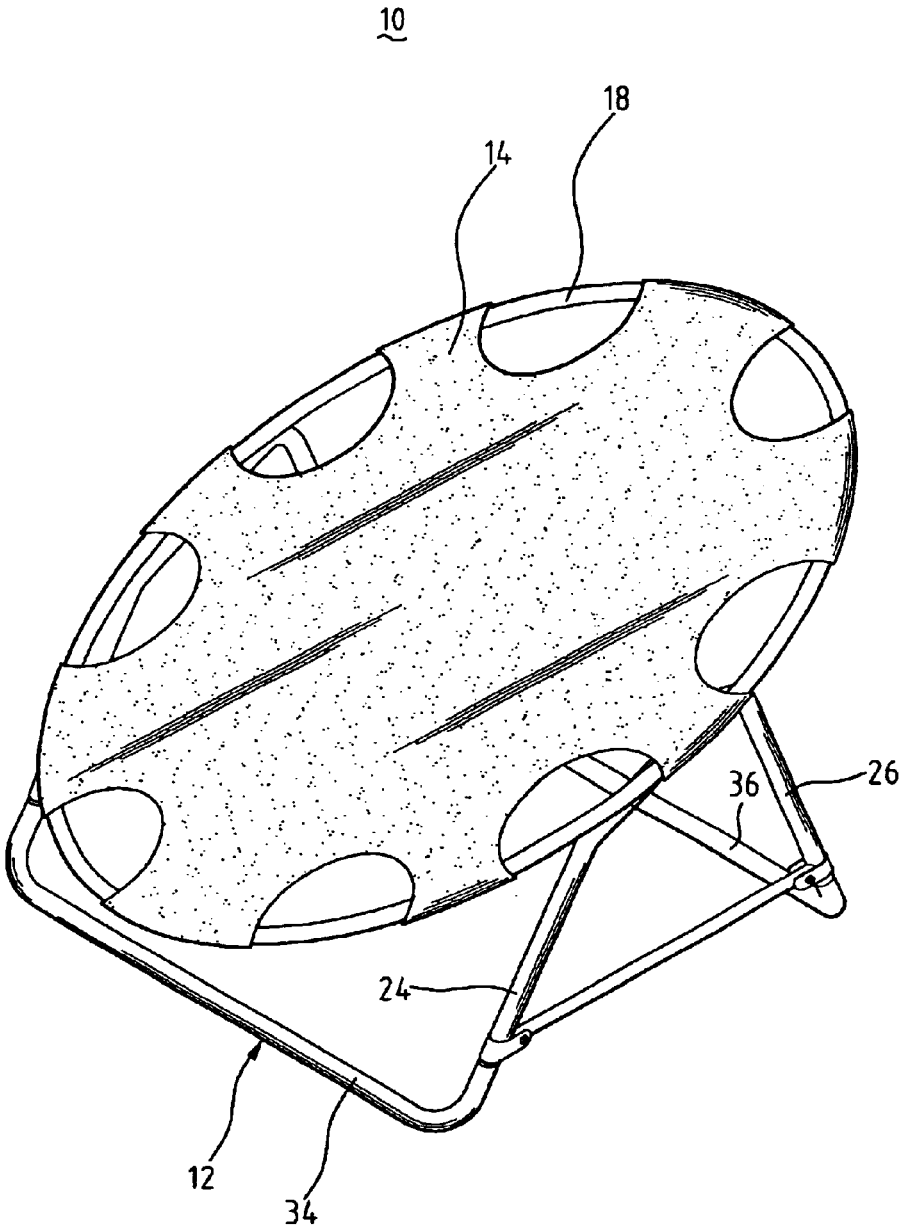
FIG. 6 is a perspective view of the collapsible chair in accordance with the present invention in the expanded condition.

With reference to the drawings and in particular to FIG. 6, a collapsible chair constructed in accordance with the present invention, generally designated with reference numeral 10, comprises a collapsible frame 12 to which a piece of flexible sheet 14 is attached to support a person (not shown) thereon.

Figure 1:
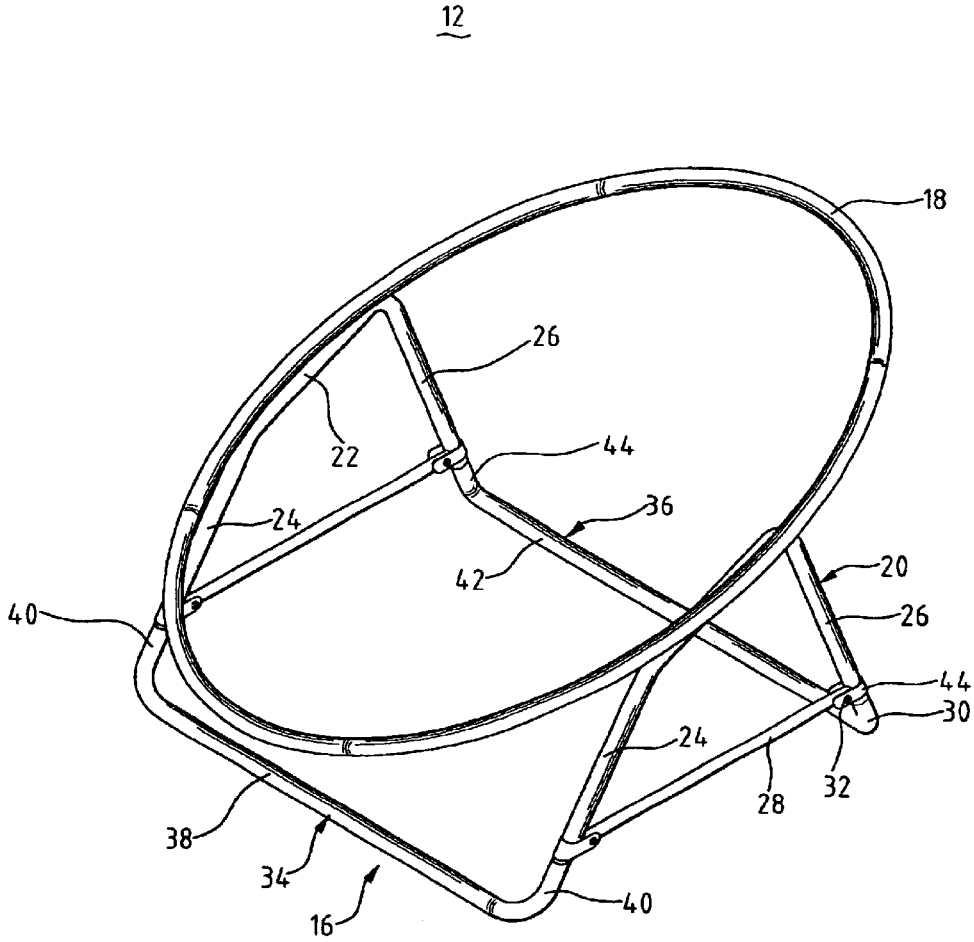
FIG. 1 is a perspective view of a frame of a collapsible chair constructed in accordance with the present invention in an expanded condition.
Figure 2:
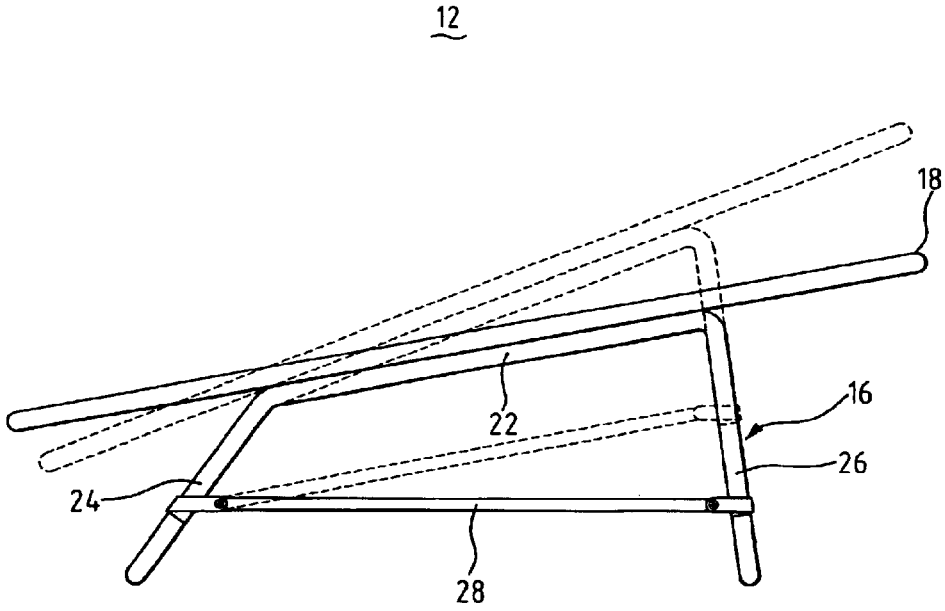
FIG. 2 is a side elevational view of the chair frame of the present invention, in which phantom lines show adjustability of inclination of the chair frame.

Also referring to FIGS. 1 and 2, the chair frame 12 comprises a base 16 and a top 18. The base 16 is positionable on a fixture surface, such as ground. The top 18 is comprised of a large ring-shaped member mounted to base 16 and is inclined with respect to the fixture surface. The flexible sheet (not shown in FIG. 1), similar to flexible sheet 14 of FIG. 6, is made of a flexible and stretchable material, such as fabrics, resilient plastics and knitted cloths, which is received in and attached to the top ring 18 at spaced positions along ring. Thus, a person may sit on the flexible sheet which depresses and stretches the flexible sheet. The person sitting on the flexible sheet is firmly supported bye the stretching of the flexible sheet at the connections between the flexible sheet and the ring 18.

The base 16 of the chair frame 12 comprises two leg structures 20 in the form of an inverted U-shape comprised of a top bar 22 and front and rear side bars 24, 26 depending from opposite ends of the top bar 22. The top ring 18 is mounted to the top bar 22. To make the top ring 18 inclined, the front and rear side bars 24, 26 are dimensioned and arranged to have the top bar 22 inclined with respect to the fixture surface, as best seen in FIG. 2. To maintain the relative position between the front and rear side bars 24, 26, a cross bar 28 extends between and is connected to the front and rear side bars 24, 26. Opposite ends of the cross bar 28 are fixed to the front and rear side bars 24, 26, respectively. In the embodiment illustrated, spaced lugs 30 are formed on each side bar 24, 26 iu receive the corresponding end (not labeled) of the cross bar 28. A pin or rivet 32 extends through both the lugs 30 and the end of the cross bar 28 received between the lugs 30 to secure the end of the cross bar 28 to the lugs 30 and thus the side bar 24, 26. The cross bar 28 may be rotatable with respect to the lugs 30, if desired.

Preferably, the rear side bar 26 is substantially vertical or upright with respect to the fixture surface, while the front side bar 24 is inclined with respect to the vertical and diverges from the rear side bar 26 in a downward direction to provide a large bottom projection area for soundly supporting the person sitting on the flexible sheet 14. It is apparent that the front and rear side bars 24, 26 can be arranged in different configurations provided sound support of the person sitting thereon can be realized.

A U-shaped front ground member 34 connects between lower ends (not labeled) of the front side bars 24 of the leg structures 20. Similarly, a U-shaped rear ground member 36 connects between lower ends (not labeled) of the rear side bars 26. The ground members 34, 36 fix the leg structures 20 together and retain the positions of the front and rear side bars 24, 26.

Figure 3:
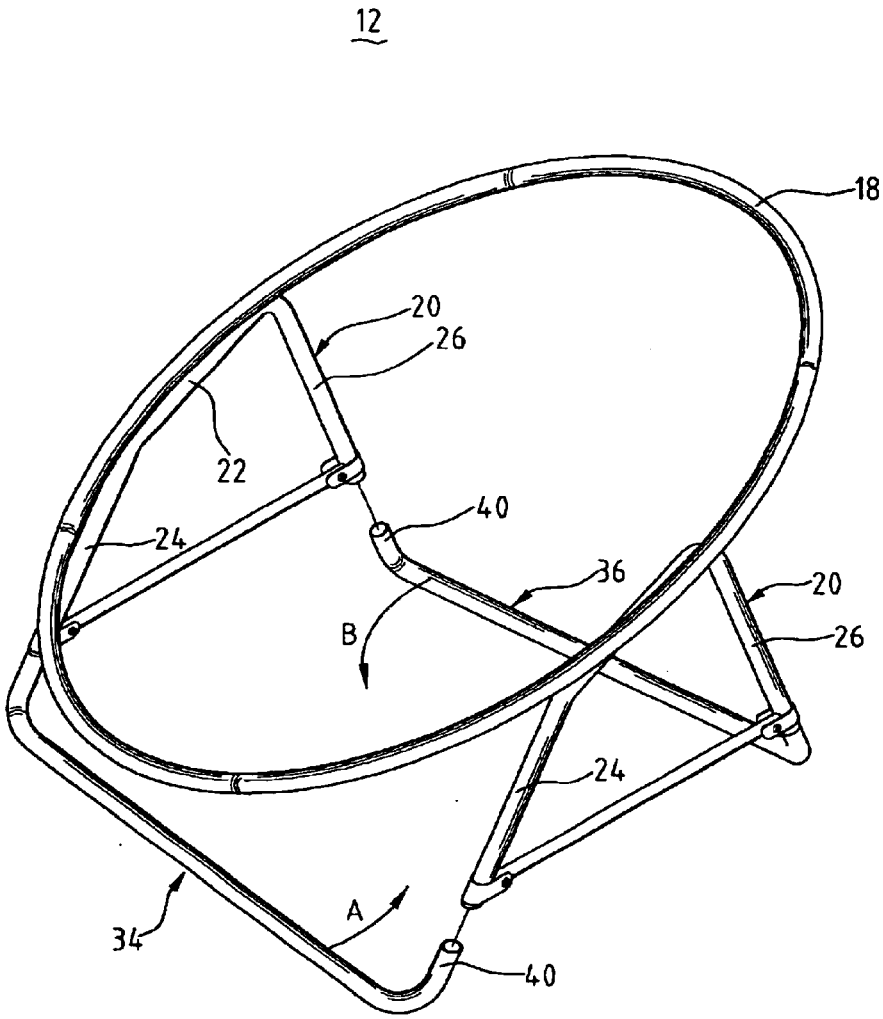
FIG. 3 is a perspective view showing an initial step of collapsing the chair frame of the present invention.

The ground members 34, 36 are of substantially the same construction and thus the discussion of the front ground member 34 is also applicable to the rear ground member 36. The front ground member 34 comprises a bottom section 38 directly positionable on the fixture surface and side sections 40 extending from opposite ends (not labeled) of the bottom section 38. The side sections 40 are tubular for receiving the lower ends of the front side bars 24 of the leg structures 20 therein. The lower ends of the front side bars 24 are removably and rotatably fit in the tubular side sections 40 of the front ground member 34. The front side bars 24 of the leg structures 20 and the side sections 40 of the front ground member 34 are dimensioned so that one of the side sections 40 is detachable from the corresponding front side bar 24, while the other side section 40 remains rotatable fitting with the other front side bar 24. This allows for rotation of the front ground member 34 with respect to the leg structures 20 about the lower end of one of the front side bars 24, as shown in FIG. 3 and indicated by arrow A.

Releasable fasteners, such as spring-biased pins (not shown), are provided between the front ground member 34 and the front side bars 24 of the leg structures 20 to selectively secure the front ground member 34 to the front side bars 24 of the leg structures 20.

Similarly, the rear ground member 36 comprises a bottom section 42 directly positionable on the fixture surface and side sections 44 extending from opposite ends of the bottom section 42. The side sections 43 are tubular for receiving the lower ends (not labeled) of the rear side bars 26 of the leg structures 20 therein. The lower ends of the rear side bars 26 are removably and rotatably fit in the tubular side sections 44 of the rear ground member 36. The rear side bars 26 of the leg structures 20 and the side sections 44 of the rear ground member 36 are dimensioned so that one of the side sections 44 is detachable from the corresponding rear side bar 26, while the other side section 44 remains rotatable fitting with the other rear side bar 26. This allows for rotation of the rear ground member 36 with respect to the leg structures 20 about the lower end of one of the rear side bars 26, as shown in FIG. 3 and indicated by arrow B.

Releasable fasteners, such as spring-biased pins (not shown), are provided between the rear ground member 36 and the rear side bars 26 of the leg structures 20 to selectively secure the rear ground member 36 to the rear side bars 26 of the leg structures 20.

The leg structure 20 itself is made collapsible. Each side bar 24, 26 of the leg structure 20 has an extension (not labeled) that is bent at a predetermined angle with respect to the side bar 24, 26 so as to be coaxial with respect to the top bar 22. The top bar 22 is tubular and the extensions of the side bars 24, 26 are rotatably fit into opposite ends of the tubular top bar 22. This allows for rotation of the side bars 24, 26 with respect to the top bar 22 when the ground members 34, 36 are disengaged from the side bars 24, 26.

Releasable fasteners, such as spring-biased pins (not shown), are provided between the side bars 24, 26 and the top bar 22 to selectively retain the angular positions of the side bars 24, 26 with respect to the top bar 22.

The top ring 18 is mounted to the top bars 22 of the leg structures 20 in such a manner that the top ring 18 partially overlaps the top bars 22 and is securely fixed thereto.

Figure 4:
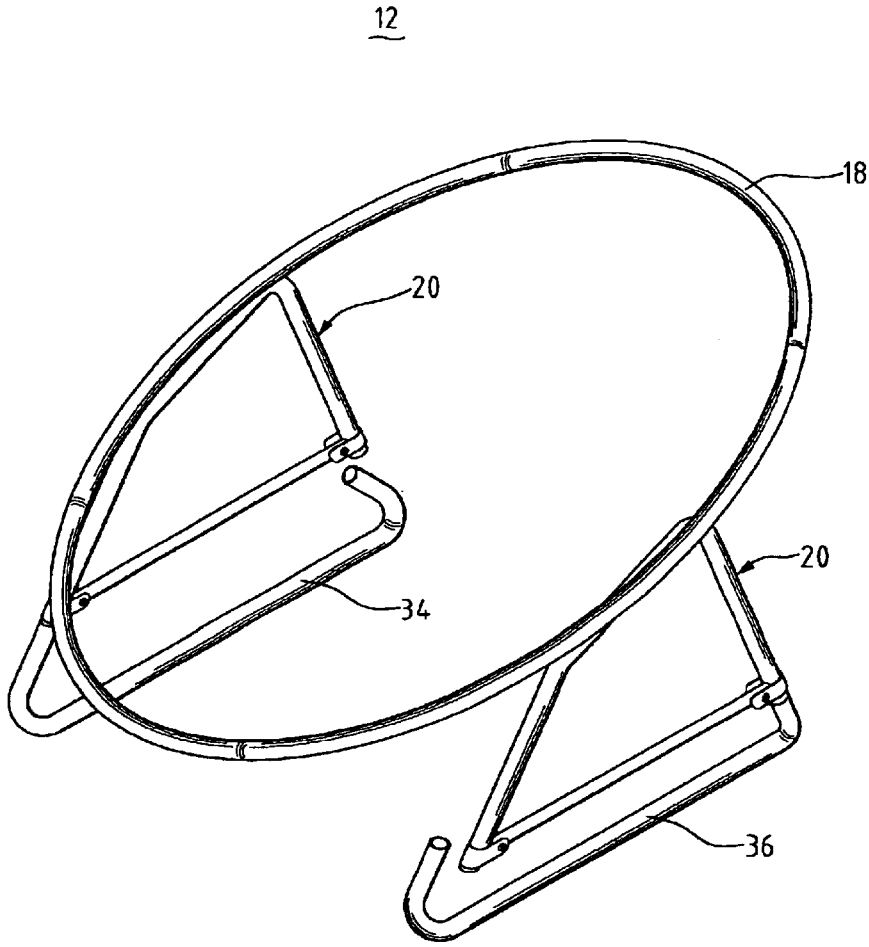
FIG. 4 is similar to FIG. 3, but showing an intermediate step of collapsing the chair frame of the present invention.
Figure 5:
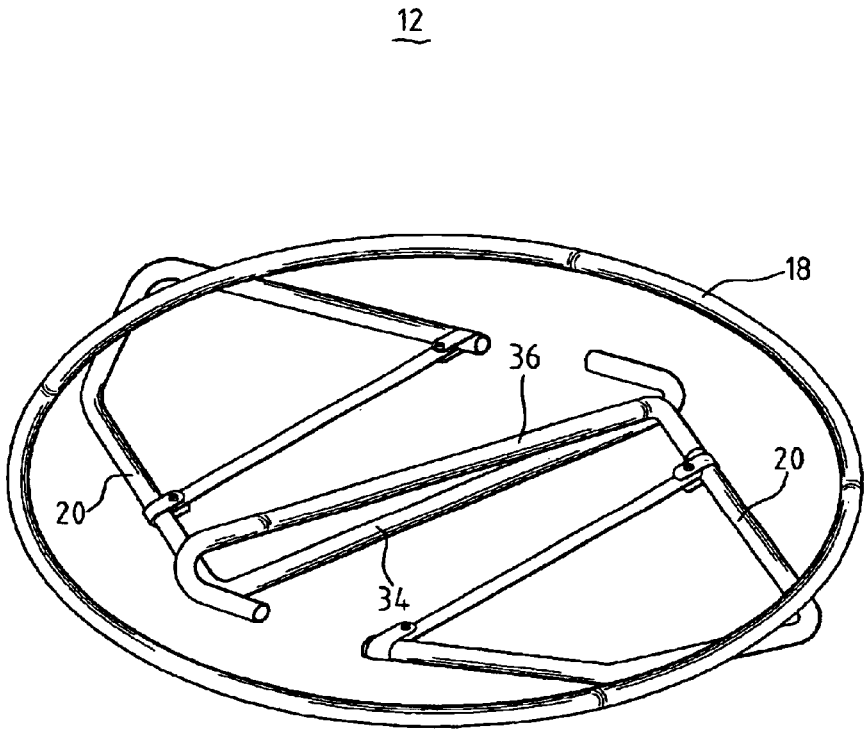
FIG. 5 is similar to FIGS. 3 and 4 but showing a final step of collapsing the chair frame of the present invention whereby the chair frame is in a collapsed condition.

Referring to FIGS. 3, 4 and 5, the collapse of the chair frame 12 will be discussed. Firstly, as shown in FIG. 3, the ground members 34, 36 are disengaged from one of the front and rear side bars 24, 26 of the leg structures 20. Thereafter, the ground members 34, 36 are rotated about the other one of the front and rear side bars 24, 26 as indicated by arrows A, B to substantially overlap the leg structures 20 as shown in FIG. 4. In the next step, the front and rear side bars 24, 26, on which the ground member 34, 36 overlaps, are rotated about the top bar 22 to underlap the top ring 18 as shown in FIG. 5. Thus, the top bars 22 are pivotally attached to the top ring 18, as illustrated in FIGS. 4 and 5, in any manner that is well known in the art. This completes the collapse of the chair frame 12.

Since the flexible sheet 14 is received in the top ring 18 and is flexible, the flexible sheet 14 does not interfere with the collapse of the chair frame 12.

Preferably, after collapse, the ground members 34, 36 are respectively attached to different leg structures 20.

Referring back to FIG. 3, the rear side bars 26 are comprised of a length adjustable construction whereby the inclination angle of the top bar 22 may be changed by adjusting the length of the rear side bars 26 as indicated by phantom lines shown in FIG. 3. An example of the length adjustable construction comprises sections telescopically fit into each other. The telescopic sections of the length adjustable construction are selectively fixed in position with respect to each other by releasable fasteners, such as spring-biased pin (not shown). Thus, the releasing the fasteners to move the sections with respect to each other, the length of the rear side bars 25 is adjusted and the inclination angle of the top bars 22 and thus the top ring 18 is adjusted correspondingly. In other words, the inclination angle of the top ring 18 and the flexible sheet 14 can be adjusted as desired, if the fastener allows for stepless length adjustment.

Although the present invention has been described with reference to the preferred embodiment thereof, it is apparent to those skilled in the art that a variety of modifications and changes may be made without departing from the scope of the present invention is intended to be defined by the appended claims.

What is claimed is:

1. A collapsible chair comprising:

a chair frame comprising:

two spaced leg structures, each comprising a top bar and front and rear side bars depending from the top bar to form a substantially U-shape, the front and rear side bars connected to the top bar, a front ground member having a U-shaped configuration comprising a bottom section adapted to be positioned on a fixture and first and second side sections extending from opposite ends of the bottom section, wherein the first side section is rotatably fit over a lower end of a first one of the front side bars of the leg structures and the second side section is removably fit over a second one of the front side bars of the leg structures, a rear ground member having a U-shaped configuration comprising a bottom section adapted to be positioned on a fixture and first and second side sections extending from opposite ends of the bottom section, wherein the first side section is rotatably fit over a lower end of a first one of the rear side bars of the leg structures and the second side section is removably fit over a second one of the rear side bars of the leg structures, and a top ring is pivotably affixed to the top bars of the leg structures; and a flexible sheet received in and attached to the top ring.

2. The collapsible chair as claimed in claim 1, further comprising a cross bar connected between the front and rear side bars of the leg structures.

3. The collapsible chair as claimed in claim 1, wherein the top bar is inclined with respect to a fixture at a predetermined inclination angle.

4. The collapsible chair as claimed in claim 3, wherein the rear side bars of the leg structures are length adjustable for changing the inclination angle of the top bar.

5. The collapsible chair as claimed in claim 1, wherein the side bars of the leg structures each have a bent extension coaxial with respect to and rotatably fit over the ends of the top bar.

* * * * *